US010352182B2

(12) United States Patent
Bergman et al.

(10) Patent No.: US 10,352,182 B2
(45) Date of Patent: Jul. 16, 2019

(54) INTERNAL COOLING OF STATOR VANES

(71) Applicant: United Technologies Corporation, Farmington, CT (US)

(72) Inventors: Russell J. Bergman, Windsor, CT (US); Brett Alan Bartling, Monroe, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 487 days.

(21) Appl. No.: 15/159,935

(22) Filed: May 20, 2016

(65) Prior Publication Data

US 2017/0335700 A1 Nov. 23, 2017

(51) Int. Cl.

| | |
|---|---|
| ***F01D 5/18*** | (2006.01) |
| ***F01D 9/04*** | (2006.01) |
| ***F01D 9/06*** | (2006.01) |

(52) U.S. Cl.

CPC ..... *F01D 9/041* (2013.01); *F01D 5/18* (2013.01); *F01D 9/065* (2013.01); *F05D 2220/32* (2013.01); *F05D 2230/10* (2013.01); *F05D 2230/232* (2013.01); *F05D 2230/237* (2013.01); *F05D 2240/10* (2013.01); *F05D 2240/121* (2013.01); *F05D 2240/81* (2013.01); *F05D 2250/324* (2013.01); *F05D 2260/202* (2013.01)

(58) Field of Classification Search

CPC ..... F01D 9/041; F01D 9/065; F01D 25/12; F05D 2240/10; F05D 2240/81

See application file for complete search history.

(56) References Cited

U.S. PATENT DOCUMENTS

| | | | | |
|---|---|---|---|---|
| 5,344,283 A * | 9/1994 | Magowan | F01D 5/187 415/115 |
| 5,488,825 A | 2/1996 | Davis et al. | |
| 6,092,983 A * | 7/2000 | Tomita | F01D 5/187 415/115 |
| 6,190,130 B1 * | 2/2001 | Fukue | F01D 5/187 415/115 |

(Continued)

FOREIGN PATENT DOCUMENTS

| | | |
|---|---|---|
| EP | 0392664 A2 | 10/1990 |
| EP | 3184751 A1 | 6/2017 |

(Continued)

OTHER PUBLICATIONS

European Search Report Issued in EP Application No. 17172075.8, dated Oct. 23, 2017, 12 Pages.

*Primary Examiner* — Igor Kershteyn
*Assistant Examiner* — Topaz L. Elliott
(74) *Attorney, Agent, or Firm* — Cantor Colburn LLP

(57) ABSTRACT

A stator for a gas turbine engine includes a stator vane, a first cooling passage located at the stator to provide a cooling fluid flow to a first portion of the stator, and a second cooling passage located at the stator to provide a cooling fluid flow to a second portion of the stator. A connection passage extends at least partially through the stator to connect a first cooling passage inlet of the first cooling passage to a second cooling passage inlet of the second cooling passage. The cooling fluid flow is directed from a common cooling flow source into the first cooling passage and the second cooling passage via the first cooling passage inlet.

20 Claims, 4 Drawing Sheets

(56) References Cited

U.S. PATENT DOCUMENTS

| | | | | |
|---|---|---|---|---|
| 6,454,526 | B1 * | 9/2002 | Cunha | F01D 5/147<br>415/115 |
| 6,572,335 | B2 * | 6/2003 | Kuwabara | F01D 5/187<br>416/96 A |
| 6,887,033 | B1 * | 5/2005 | Phillips | F01D 5/147<br>415/115 |
| 7,976,274 | B2 * | 7/2011 | Lee | F01D 5/143<br>415/190 |
| 8,231,348 | B2 * | 7/2012 | Torii | F01D 5/18<br>415/115 |
| 9,085,987 | B2 * | 7/2015 | Hada | F01D 5/187 |
| 9,091,180 | B2 * | 7/2015 | Wiebe | F01D 25/00 |
| 9,562,439 | B2 * | 2/2017 | Iduate | F01D 9/065 |
| 9,644,485 | B2 * | 5/2017 | Otomo | F01D 5/02 |
| 9,822,653 | B2 * | 11/2017 | Porter | F01D 9/041 |
| 10,001,013 | B2 * | 6/2018 | Vantassel | B23P 15/02 |
| 2014/0023483 | A1 * | 1/2014 | Wiebe | F01D 25/00<br>415/115 |
| 2016/0177782 | A1 * | 6/2016 | Hough | F01D 5/187<br>415/115 |
| 2017/0198588 | A1 * | 7/2017 | Spangler | F01D 5/186 |
| 2018/0200783 | A1 * | 7/2018 | Takamura | B22C 9/04 |

FOREIGN PATENT DOCUMENTS

| | | | |
|---|---|---|---|
| GB | 2263946 | A | 8/1993 |
| WO | 2015026597 | A1 | 2/2015 |

* cited by examiner

INTERNAL COOLING OF STATOR VANES

BACKGROUND

This disclosure relates to gas turbine engines, and more particularly to the provision of cooling air for components of gas turbine engines.

Gas turbines hot section components, in particular turbine vanes and blades in the turbine section of the gas turbine are configured for use within particular temperature ranges. Such components often rely on cooling airflow to maintain turbine components within this particular temperature range. For example, stationary turbine vanes often have internal passages for cooling airflow to flow through, and additionally may have openings in an outer surface of the vane for cooling airflow to exit the interior of the vane structure and form a cooling film of air over the outer surface to provide the necessary thermal conditioning. Other components of the turbine often also require such thermal conditioning to reduce thermal gradients that would otherwise be present in the structure and which are generally undesirable. Thus, ways to increase thermal conditioning capability in the turbine are desired.

The internal cooling passages are typically formed in stator vanes through the use of ceramic cores during the casting process of the stator vanes. The complex geometry of the cooling passages typically prevents advantageously combining ceramic cores into a single core, which would significantly improve producibility of the stator vane. Further, as separate cores are utilized, cooling air flowed through the cooling passages is therefore fed from separate cooling airflow sources, which in many instances may not be optimal cooling air sources.

SUMMARY

In one embodiment, a stator for a gas turbine engine includes a vane, a first cooling passage located at the stator to provide a cooling fluid flow to a first portion of the stator, and a second cooling passage located at the stator to provide a cooling fluid flow to a second portion of the stator. A connection passage extends at least partially through the stator to connect a first cooling passage inlet of the first cooling passage to a second cooling passage inlet of the second cooling passage. The cooling fluid flow is directed from a common cooling flow source into the first cooling passage and the second cooling passage via the first cooling passage inlet.

Additionally or alternatively, in this or other embodiments the first cooling passage is a vane leading edge cooling passage of the vane, and the second cooling passage is a platform cooling passage located at a stator platform.

Additionally or alternatively, in this or other embodiments the connection passage includes a passage opening in an external surface of the stator, and a closure secured over the passage opening to prevent leakage of the cooling fluid flow through the passage opening.

Additionally or alternatively, in this or other embodiments the closure is one of a plug or a cover.

Additionally or alternatively, in this or other embodiments the closure is secured over the passage opening via welding or brazing.

Additionally or alternatively, in this or other embodiments the first cooling passage inlet extends radially outwardly to a greater extent than the second cooling passage inlet.

In another embodiment, a turbine of a gas turbine engine includes a turbine rotor, and a turbine stator including a vane, a first cooling passage located at the turbine stator to provide a cooling fluid flow to a first portion of the turbine stator and a second cooling passage located at the turbine stator to provide a cooling fluid flow to a second portion of the turbine stator. A connection passage extends at least partially through the turbine stator to connect a first cooling passage inlet of the first cooling passage to a second cooling passage inlet of the second cooling passage. The cooling fluid flow is directed from a common cooling fluid source into the first cooling passage and the second cooling passage via the first cooling passage inlet.

Additionally or alternatively, in this or other embodiments the first cooling passage is a vane leading edge cooling passage of the vane, and the second cooling passage is a platform cooling passage located at a stator platform.

Additionally or alternatively, in this or other embodiments the turbine stator includes a closure located at an external surface of the turbine stator to prevent leakage of the cooling fluid flow from the connection passage.

Additionally or alternatively, in this or other embodiments the closure is one of a plug or a cover.

Additionally or alternatively, in this or other embodiments the closure is secured at the external surface via welding or brazing.

Additionally or alternatively, in this or other embodiments the first cooling passage inlet extends radially outwardly to a greater extent than the second cooling passage inlet.

In yet another embodiment, a method of cooling a stator for a gas turbine engine includes forming a first cooling passage in a stator, forming a second cooling passage in the stator separate from the first cooling passage, forming a connection passage in the stator to connect a first cooling passage inlet of the first cooling passage to a second cooling passage inlet of the second cooling passage, and connecting the first cooling passage inlet to a cooling flow source.

Additionally or alternatively, in this or other embodiments a cooling flow is directed from the cooling flow source through the first cooling passage inlet and a first portion of the cooling flow is directed from the first cooling passage inlet through the connecting passage to the second cooling passage.

Additionally or alternatively, in this or other embodiments the first portion of the cooling flow is directed into the second cooling passage and a second portion of the cooling flow is directed into the first cooling passage.

Additionally or alternatively, in this or other embodiments forming of the connection passage includes drilling the connection passage from an external surface of the stator through one of the first cooling passage inlet or the second cooling passage inlet and into the other of the first cooling passage inlet or the second cooling passage inlet.

Additionally or alternatively, in this or other embodiments a closure is secured at an opening formed at the external surface.

Additionally or alternatively, in this or other embodiments the closure is one of a plug or a cover.

Additionally or alternatively, in this or other embodiments the first cooling passage is a vane leading edge cooling passage of the stator and the second cooling passage is a platform cooling passage disposed at a stator platform.

Additionally or alternatively, in this or other embodiments one of the first cooling passage inlet or the second cooling inlet passage extends radially outwardly to a greater extent than the other of the first cooling passage inlet or the second cooling passage inlet.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
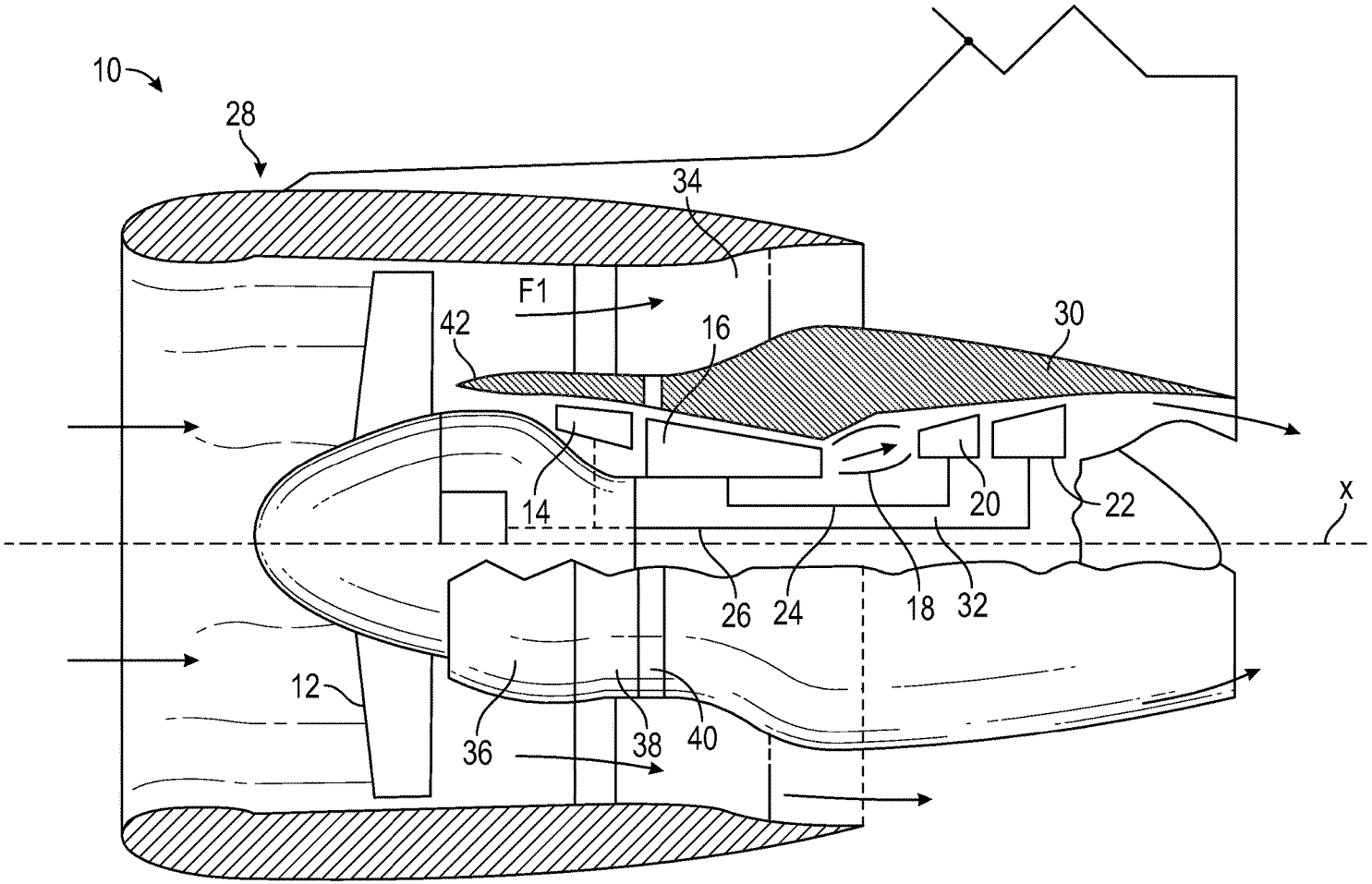
FIG. 1 illustrates a schematic cross-sectional view of an embodiment of a gas turbine engine.

FIG. 1 is a schematic illustration of a gas turbine engine 10. The gas turbine engine generally has includes fan section 12, a low pressure compressor 14, a high pressure compressor 16, a combustor 18, a high pressure turbine 20 and a low pressure turbine 22. The gas turbine engine 10 is circumferentially disposed about an engine centerline X. During operation, air is pulled into the gas turbine engine 10 by the fan section 12, pressurized by the compressors 14, 16, mixed with fuel and burned in the combustor 18. Hot combustion gases generated within the combustor 18 flow through high and low pressure turbines 20, 22, which extract energy from the hot combustion gases.

In a two-spool configuration, the high pressure turbine 20 utilizes the extracted energy from the hot combustion gases to power the high pressure compressor 16 through a high speed shaft 24, and the low pressure turbine 22 utilizes the energy extracted from the hot combustion gases to power the low pressure compressor 14 and the fan section 12 through a low speed shaft 26. The present disclosure, however, is not limited to the two-spool configuration described and may be utilized with other configurations, such as single-spool or three-spool configurations, or gear-driven fan configurations.

Gas turbine engine 10 is in the form of a high bypass ratio turbine engine mounted within a nacelle or fan casing 28 which surrounds an engine casing 30 housing an engine core 32. A significant amount of air pressurized by the fan section 12 bypasses the engine core 32 for the generation of propulsive thrust. The airflow entering the fan section 12 may bypass the engine core 32 via a fan bypass passage 34 extending between the fan casing 28 and the engine casing 30 for receiving and communicating a discharge flow F1. The high bypass flow arrangement provides a significant amount of thrust for powering an aircraft.

The engine casing 30 generally includes an inlet case 36, a low pressure compressor case 38, and an intermediate case 40. The inlet case 36 guides air to the low pressure compressor case 38, and via a splitter 42 also directs air through the fan bypass passage 34.

Figure 2:
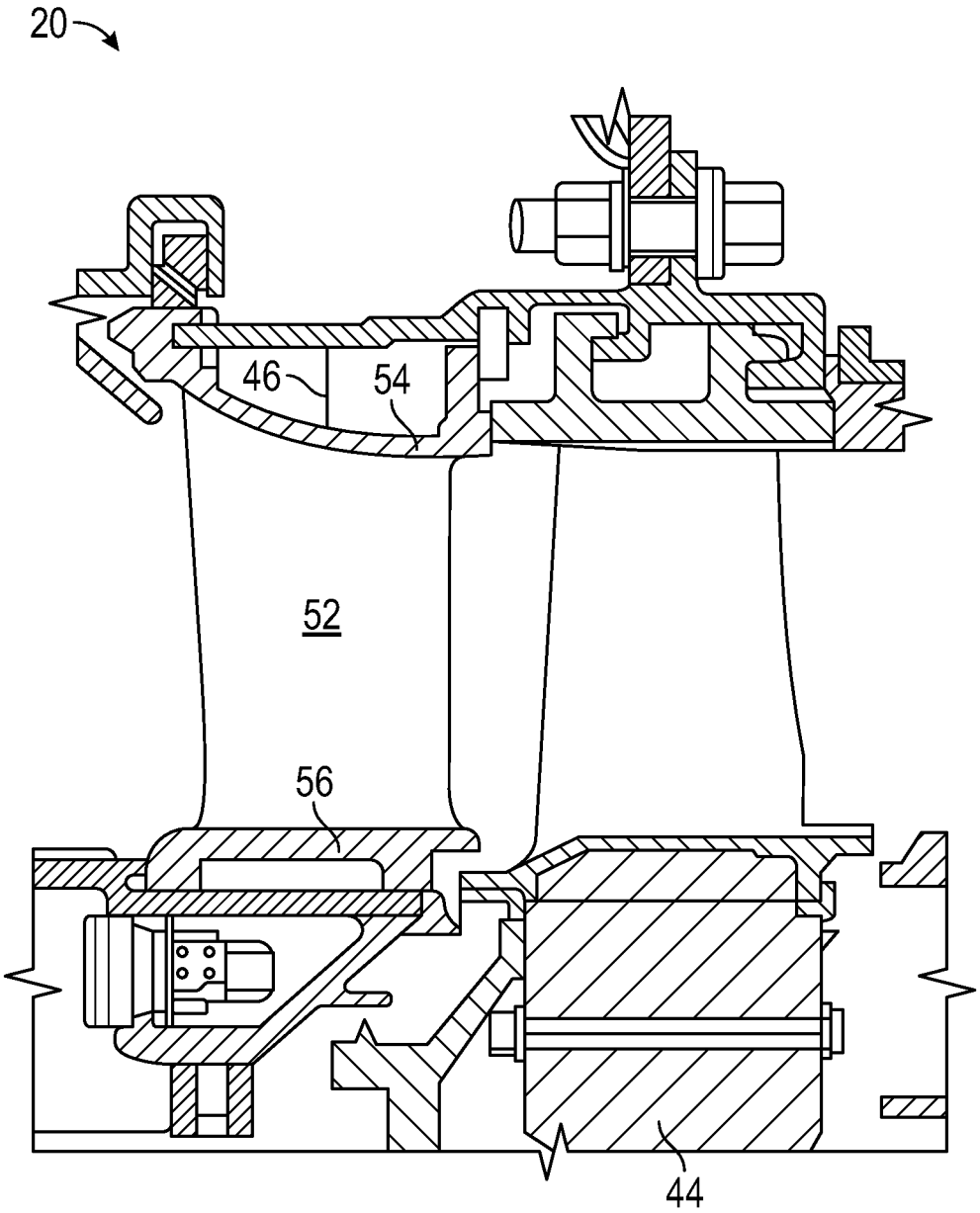
FIG. 2 illustrates a schematic cross-sectional view of an embodiment of a turbine section of a gas turbine engine.

Referring now to FIG. 2, the high pressure turbine 20 includes one or more high pressure turbine rotors 44 in an axially-alternating arrangement with one or more high pressure turbine (HPT) stators 46. Similarly, the low pressure turbine 22 includes one or more low pressure turbine rotors in an axially-alternating arrangement with one or more low pressure turbine stators. The following description is in reference to a high pressure turbine stator 46, but one skilled in the art will readily appreciate that the disclosure provided herein may be similarly utilized in a low pressure turbine stator, or similar turbine compressor components having internal cooling passages. The HPT stator 46 includes a turbine vane 52 and an outer platform 54 located at a radially outboard extent of the turbine vane 52, and an inner platform 56 located at a radially inboard extent of the turbine vane 52.

Figure 3:
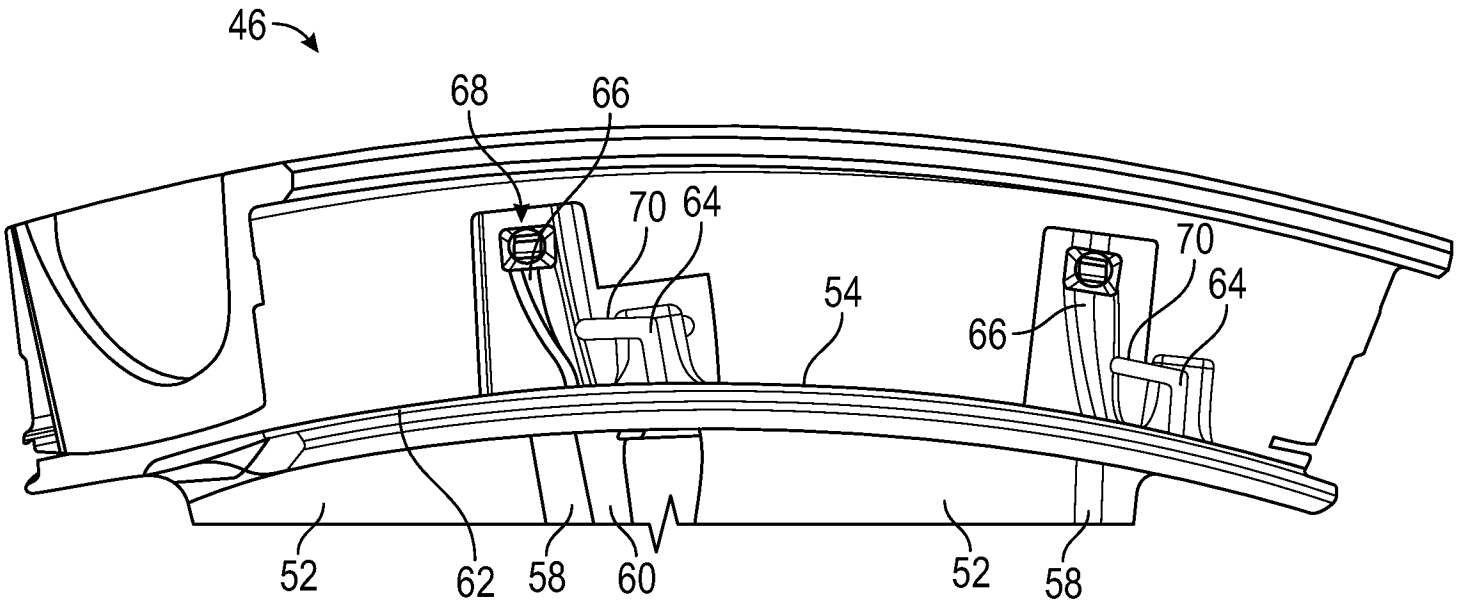
FIG. 3 is a schematic view of an embodiment of a cooling flow passage arrangement for a stator vane.

Referring now to FIG. 3, because of high operating temperatures in this portion of the gas turbine engine 10, the HPT stator 46 is provided with cooling passages to distribute cooling airflow internally throughout the HPT stator 46. In some embodiments, the cooling passages circulate the cooling airflow in an interior of the HPT stator 46, while in other embodiments the cooling passages communicate with film cooling holes (not shown) on the HPT stator 46 to form a cooling film one or more external surfaces of the HPT stator 46.

In the embodiment of FIG. 3, at least two cooling passages are formed in the HPT stator 46, a vane leading edge cooling passage 58 extending along a vane leading edge 60, and a platform cooling passage 62 extending along the outer platform 54. The platform cooling passage 62 has a platform cooling inlet 64, while the vane leading edge cooling passage 58 has a leading edge cooling inlet 66. Due to the complexity of the cooling passage geometry, the vane leading edge cooling passage 58 is formed separately from the platform cooling passage 62, and the platform cooling inlet 64 is separate from the leading edge cooling inlet 66.

Figure 4:
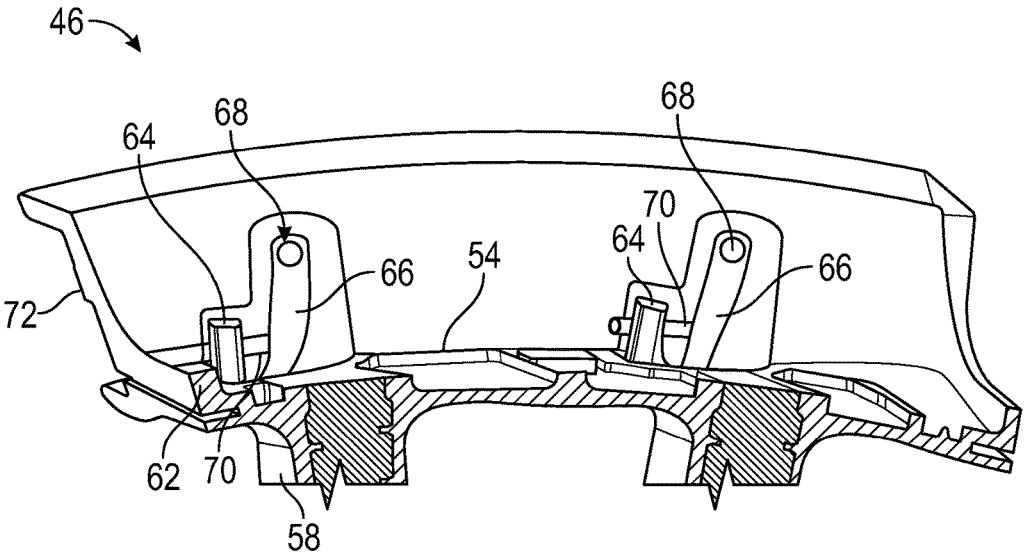
FIG. 4 is a schematic view of an embodiment of a connection passage for a cooling flow passage arrangement.

Referring now to FIG. 4, it is desired to feed the cooling airflow to the platform cooling inlet 64 and the leading edge cooling inlet 66 from a common cooling flow source 68. For example, in some embodiments, it is desired to locate the cooling flow source 68 at a radially outboardmost practicable location, where the cooling airflow has a relatively low temperature and high pressure, relative to radially inboard locations. To feed the platform cooling inlet 64 and the leading edge cooling inlet 66 from the common cooling flow source 68, a communication passage 70 is formed in the HPT stator 46. The communication passage 70 extends, in this embodiment, between the leading edge cooling inlet 66 and the platform cooling inlet 64 with the leading edge cooling inlet 66 connected to the common cooling flow source 68.

In some embodiments, the connection passage 70 is formed in the HPT stator 46 by drilling. The connection passage 70 is drilled by, for example, drilling through an external surface 72 of the HPT stator 46 at the platform cooling inlet 64. The connection passage 70 is drilled from the external surface 72, through the platform cooling inlet 64 and into the leading edge cooling inlet 66. It is to be appreciated that the forming of the connection passage 70 described herein is merely exemplary, one skilled in the art will readily appreciate that other methods may be utilized to form the connection passage 70. In some embodiments, the connection passage 70 extends between the platform cooling inlet 64 and the leading edge cooling inlet 66 in a circumferential direction.

Figure 5:
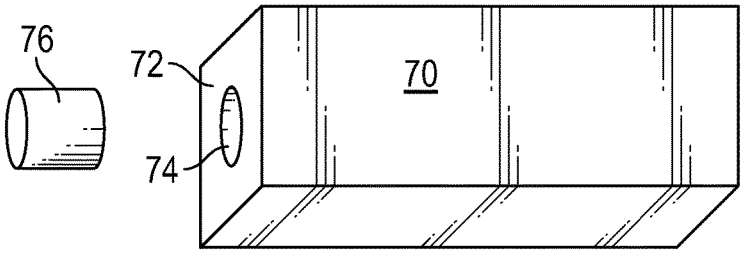
FIG. 5 is another schematic view of an embodiment of a connection passage for a cooling flow passage arrangement.

Referring now to FIG. 5, once the connection passage 70 is formed, an external surface opening 74 must be closed to prevent leakage of the cooling airflow. The external surface opening may be closed via a closure, such as a plug 76 that is secured in place in the external surface opening 74 by, for example, welding or brazing. Other means may also be used to close the external surface opening 74, such as a sheet metal cover secured over external surface opening 74 may be utilized.

Utilizing the connection passage 70 allows for a HPT stator 46 casting with improved producibility, while utilizing a selected cooling flow source 68 that improves gas turbine engine 10 efficiency and durability.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A stator for a gas turbine engine comprising:

a vane;

a first cooling passage disposed at the stator to provide cooling fluid to a first portion of the stator, the first cooling passage including a first cooling passage inlet portion extending radially outwardly from a vane platform located at the radially outwardmost extent of the vane;

a second cooling passage disposed at the stator to provide cooling fluid to a second portion of the stator, the second cooling passage including a second cooling passage inlet portion extending radially outwardly from the vane platform;

a connection passage extending at least partially through the stator to connect the first cooling passage inlet portion to the second cooling passage inlet portion to allow fluid communication between the first cooling passage inlet portion and the second cooling passage inlet portion via the connection passage, the connection passage branching off of the first cooling passage inlet portion and extending to the second cooling passage inlet portion thereby connecting the first cooling passage inlet portion to the second cooling passage inlet portion; and a common cooling flow source from which cooling fluid is directed into the first cooling passage and the second cooling passage via the first cooling passage inlet portion;

wherein:

the first cooling passage is a vane cooling passage of the vane; and the second cooling passage is a platform cooling passage disposed at a stator platform.

2. The stator of claim 1, wherein:

the first cooling passage is a vane leading edge cooling passage of the vane.

3. The stator of claim 1, wherein the connection passage includes:

a passage opening in an external surface of the stator; and a closure secured over the passage opening to prevent leakage of cooling fluid through the passage opening.

4. The stator of claim 3, wherein the closure is one of a plug or a cover.

5. The stator of claim 3, wherein the closure is secured over the passage opening via welding or brazing.

6. The stator of claim 1, wherein the first cooling passage inlet portion extends radially outward of the second cooling passage inlet portion.

7. A turbine of a gas turbine engine, comprising:

a turbine rotor; and a turbine stator including:

a vane;

a first cooling passage disposed at the stator to provide cooling fluid to a first portion of the stator, the first cooling passage including a first cooling passage inlet portion extending radially outwardly from a vane platform located at the radially outwardmost extent of the vane;

a second cooling passage disposed at the stator to provide cooling fluid to a second portion of the stator, the second cooling passage including a second cooling passage inlet portion extending radially outwardly from the vane platform;

a connection passage extending at least partially through the stator to connect the first cooling passage inlet portion to the second cooling passage inlet portion to allow fluid communication between the first cooling passage inlet portion and the second cooling passage inlet portion via the connection passage, the connection passage branching off of the first cooling passage inlet portion and extending to the second cooling passage inlet portion thereby connecting the first cooling passage inlet portion to the second cooling passage inlet portion; and a common cooling flow source from which cooling fluid is directed into the first cooling passage and the second cooling passage via the first cooling passage inlet portion;

wherein:

the first cooling passage is a vane cooling passage of the vane; and the second cooling passage is a platform cooling passage disposed at a stator platform.

8. The turbine of claim 7, wherein:

the first cooling passage is a vane leading edge cooling passage of the vane.

9. The turbine of claim 7, wherein the turbine stator includes a closure disposed at an external surface of the turbine stator to prevent leakage of cooling fluid from the connection passage.

10. The turbine of claim 9, wherein the closure is one of a plug or a cover.

11. The turbine of claim 9, wherein the closure is secured at the external surface via welding or brazing.

12. The turbine of claim 7, wherein the first cooling passage inlet portion extends radially outward of the second cooling passage inlet portion.

13. A method of cooling a stator for a gas turbine engine, comprising:

forming a first cooling passage in a stator, the first cooling passage including a first cooling passage inlet portion extending radially outwardly from a vane platform located at the radially outwardmost extent of a vane of the stator;

forming a second cooling passage in the stator separate from the first cooling passage, the second cooling passage including a second cooling passage inlet portion extending radially outwardly from the vane platform;

forming a connection passage in the stator to connect the first cooling passage inlet portion to the second cooling passage inlet portion to allow fluid communication between the first cooling passage inlet portion and the second cooling passage inlet portion via the connection passage, the connection passage branching off of the first cooling passage inlet portion and extending to the second cooling passage inlet portion thereby connecting the first cooling passage inlet portion to the second cooling passage inlet portion; and connecting the first cooling passage inlet portion to a cooling flow source;

wherein:

the first cooling passage is a vane cooling passage of the vane; and the second cooling passage is a platform cooling passage disposed at a stator platform.

14. The method of claim 13, further comprising:

directing a cooling flow from the cooling flow source through the first cooling passage inlet portion; and directing a first portion of the cooling flow from the first cooling passage inlet portion through the connecting passage to the second cooling passage.

15. The method of claim 14, further comprising:

directing the first portion of the cooling flow into the second cooling passage; and directing a second portion of the cooling flow into the first cooling passage.

16. The method of claim 13, wherein forming of the connection passage includes drilling the connection passage from an external surface of the stator through one of the first cooling passage inlet portion or the second cooling passage inlet portion and into the other of the first cooling passage inlet portion or the second cooling passage inlet portion.

17. The method of claim 16, further comprising securing a closure at an opening formed at the external surface.

18. The method of claim 17, wherein the closure is one of a plug or a cover.

19. The method of claim 13, wherein:

the first cooling passage is a vane leading edge cooling passage of the stator.

20. The method of claim 13, wherein one of the first cooling passage inlet portion or the second cooling passage inlet portion extends radially outward of the other of the first cooling passage inlet portion or the second cooling passage inlet portion.

* * * * *